United States Patent [19]

McKervey

[11] Patent Number: 4,780,992

[45] Date of Patent: Nov. 1, 1988

[54] APPARATUS FOR CLEANING POOL TILE

[76] Inventor: Roy B. McKervey, 3029 W. Tuckey La., Phoenix, Ariz. 85017

[21] Appl. No.: 45,320

[22] Filed: May 4, 1987

[51] Int. Cl.[4] ..... B24B 23/00

[52] U.S. Cl. ..... 51/180; 15/1.7; 15/49 R

[58] Field of Search ..... 51/170 R, 180, 181 R; 15/1.7, 28, 49 R, 29, 49 C, 328, 50 R, 50 C

[56] References Cited

U.S. PATENT DOCUMENTS

| | | | |
|---|---|---|---|
| 1,578,013 | 3/1926 | Case | 15/29 |
| 3,688,139 | 8/1972 | Yaguchi | 15/29 |
| 4,004,312 | 1/1977 | Eason | 15/29 |
| 4,202,068 | 5/1980 | Lester et al. | 15/28 |
| 4,208,753 | 6/1980 | Lewis | 15/29 |
| 4,237,570 | 12/1980 | Brock, Jr. | 15/28 |
| 4,242,794 | 1/1981 | Peterson | 15/328 |
| 4,324,015 | 4/1982 | Head | 15/1.7 |
| 4,335,481 | 6/1982 | Slayman | 15/29 |

*Primary Examiner*—Roscoe V. Parker

*Attorney, Agent, or Firm*—Louise S. Heim

[57] ABSTRACT

An apparatus for cleaning pool tile comprises the body of a string trimmer, an abrasion member detachably mounted at the end of the rotatable drive shaft of the string trimmer in place of the usual lawn care accessory, and a dispensing unit for delivering cleaning fluid to the surface of the abrasion member.

24 Claims, 1 Drawing Sheet

10
12
14
16
18
20
22
24
26
28
30
31
31A
31B
32
32B
33
34
34A
34B
35
36
37
38
39
40
41
42
44
46
48
50
52
54
56
58
60
62
64
66
68
70
2
3
5
6

APPARATUS FOR CLEANING POOL TILE

BACKGROUND OF THE INVENTION

1. Field of the Invention

This invention relates in general to cleaning devices and, more particuiarly, to an assembly for converting a gasoline powered string trimmer to a rotary abrasion apparatus for cleaning pool tile and the like.

2. Description of the Prior Art

Although a great number of highly sophisticated and complex devices have been developed for cleaning the water in swimming pools, only a few rudimentary implements are available for removing the calcium and lime deposits, oils, grease, scum and the like which tend to build up on the tile walls of poois. These implements inciude pumice stones, hand held scrub brushes, and various chemical cleansers or abrasives which the pool owner must rub onto the tile surface, generally while standing in the pool or while kneeling or crouching on its edge. Unfortunately, the laborious nature of this hand-scrubbing process tends to dissuade people from cleaning their tiles as frequently as they should. Thus, the layer of accumulated deposits becomes thicker and harder to remove with time, resulting in added labor and aggravation for the owner of the pool.

One prior art attempt to solve this problem is described in U.S. Pat. No. 4,004,312 to Eason, which relates to a tool for washing concrete surfaces and swimming pool walls. The tool of Eason includes a round brush member rotatably disposed within a hollow open ended housing. A hollow tubing portion with a handle element formed at one end is affixed to the housing, with the longitudinal axis of the tubing portion defining an acute angle relative to the top planar surface of the housing. The tubing portion also includes a fitting for attaching a hose to communlcate flulds thereto. To operate the tool, fluid from the hose is directed through the tubing element and on to a plurality of fin elements provided on the back of the brush member, imparting rotation thereto. One problem with Eason's device is that the angle of the brush member relative to the handle makes the tool more suitable for cleaning horizontal surfaces such as pool floors than for the vertical walls of a pool. Another problem with the device is that it requires attachment to a source of pressurized water, which increases the weight of the tool and limits the amount of distance over which the tool can be carried. Still another problem with the device is that it lacks versatility; i.e., it can oniy be used for cieaning certain types of surfaces, and thus may not merit its cost to the consumer.

Other prior art of interest is described in U.S. Pat. Nos. 1,578,013 to Case, 4,202,068 to Lester et al, 4,208,753 to Lewis, and 4,237,570 to Brock. All of the above relate to tools having rotary brushes suitable for a wide variety of uses such as scrubbing and polishing of floors, utensils, and furniture, and cleaning the exterior surface of automobiles and airplanes. However, none of these prior art cleaning devices would be suitable for use on swimming pool tile, for a variety of reasons. For instance, a number of the devices are electrically powered, which makes them hazardous to use near water. Others are pneumatically or hydraulically powered, which requires connection to a remote source of pressurized air or water. In addltion, the brush angles make them inconvenient for use on vertical walls. Still further, like the device of Eason, they are limited to a single basic function, and would cost more than their occasional use by a pool owner would justify.

Therefore, a long felt need exists for a new and improved pool tile cleaning tool which overcomes some of the shortcomings of the prior art.

SUMMARY OF THE INVENTION

In accordance with the present invention, a new and improved conversion assembly is provided for converting a gasoline powered string trimmer to a rotary abrasion apparatus for cleaning pool tile.

As is well known, a conventional string trimmer utilizes a flexible, non-metallic monofilament cutting line which is rotated at variable speeds beneath a detachable, protective line shield to cut weeds or grass in places that a conventional lawn mower cannot reach. In a typical arrangement, the cutting line is coiled inside a protective spool-type head which is detachably mounted on a collar at the end of a drive shaft. The collar is rotatable with the drive shaft, which extends upwardly through an elongated pole handle having a substantially vertical lower portion and a slanted upper portion which extends rearwardly toward the operator at an angle of approximately 45°. A gasoline engine is mounted at the uppermost end of the handle for powering the drive shaft. Some models of string trimmers include various accessories such as multi-tooth blades which are interchangeable with the cutting line head for enabling the trimmer to perform other types of yard work such as clearing tall weeds and brush.

The conversion assembly of the present invention comprises a detachable abrasion member which is adapted to be connected to the drive shaft of a string trimmer of the type described above, in place of the cutting line head or other lawn care accessory. In addition, a detachable dispensing unit is provided for delivering a stream of cleaning solution to the surface of the abrasion member.

In one embodiment of the invention, suitable for cleaning vertical surfaces such as the side walls of a pool, the abrasion member comprises a substantially cylindrical brush having a plurality of bristles which extend radially outwardly with respect to the longitudinal axis of the pole handle of the trimmer. The abrasion member also includes a mounting portion such as an axiaily extending shank for connecting the brush to a specially formed adapter element coupled to the collar at the end of the trimmer's rotatable drive shaft.

In another embodiment of the invention, also suitable for cleaning the vertical side walis of a pool, the abrasion member comprises a pumice stone having a substantially cylindrical outer surface. The pumice stone is also provided with a mounting portion such as an axially extending shank for coupling it to the adapter element. This embodiment of the invention is effective for removing especially thick, solid deposits of calcium and the like which do not respond to treatment with a bristle-type brush.

In yet another embodiment, used for cleaning horizontal surfaces such as floors and the like, the abrasion member comprises a brush having a transverse body portion which extends substantially normally to the longitudinal axis of the trimmer handle. A plurality of bristles extend perpendicularly from the body portion in a substantially vertical direction. Preferably, the body portion is provided with a swivel joint for allowing the position of the brush relative to the trimmer handle to be adjusted in order to clean slanted surfaces or to allow the brush to yield in response to obstructions or obstacles in its path.

The dispensing unit of the assembly comprises a bottle containing cleaning fluid which is clipped or otherwise detachably mounted on the upper exterior surface of the trimmer's pole handle. The bottle may include a discharge assistant such as a trigger-operated or push-button type piston pump, or it may be provided with a drip-feeder type outlet which allows the cleaning fluid to be continuously dispensed in a drop-by-drop fashion. An elongated discharge hose is connected to the outlet of the bottle for directing the cleaning fluid from the bottle to the surface of the abrasion member or tile or other surface being cleaned. In addition, a guide member is detachably mounted on the lower portion of the handie poie for supporting the discharge hose in spaced relationship to the exterior surface of the pole.

To use the device for cleaning the vertical side tile walls of a swimming pool, it is simply necessary for the operator to stand at the rim of the pool, extending the vertical lower portion down into the pool so that the brush member contacts the surface to be cleaned, which is preferably above the water level of the pool. The operator then actuates the gasoline powered motor of the device to rotate the abrasion member, and dispenses a small amount of cleaning fluid onto the surface of the abrasion member. He or she may then move the device slowly around the perimeter of the pool until the entire rim of the pool has been cleaned. In order to clean other types of surfaces, the operator may substitute other kinds of abrasion members, and may hold the pole handle in different positions relative to the surface.

Accordingly, it is an object of this invention to provide a new and improved conversion assembly for converting a gasoline powered string trimmer to a rotary abrasion apparatus for cleaning pool tile.

Another object of the invention is to provide a rotary abrasion apparatus which enables its operator to clean the vertical side tile walls of a swimming pool while standing above the pool.

Still another object of the invention is to provide a pool tile cleaning apparatus with a plurality of interchangeable abrasion members, including various types of brushes and a pumice stone for removing calcium build-up from the walls of the pool.

Yet another object of the invention is to provide an abrasion member and dlspensing unit for detachable mounting on the body of a string trimmer to make an inexpensive and convenient pool tile cleaning device.

The foregoing and other objects of the present invention, as well as the invention itself, may be more fully understood from the following description when read in conjunction with the accompanying drawings.

BRIEF DESCPIPTION OF THE DRAWINGS

DESCRIPTION OF THE PREFERRED EMBODIMENTS

Figures 1, 2, 3, 4, 5:
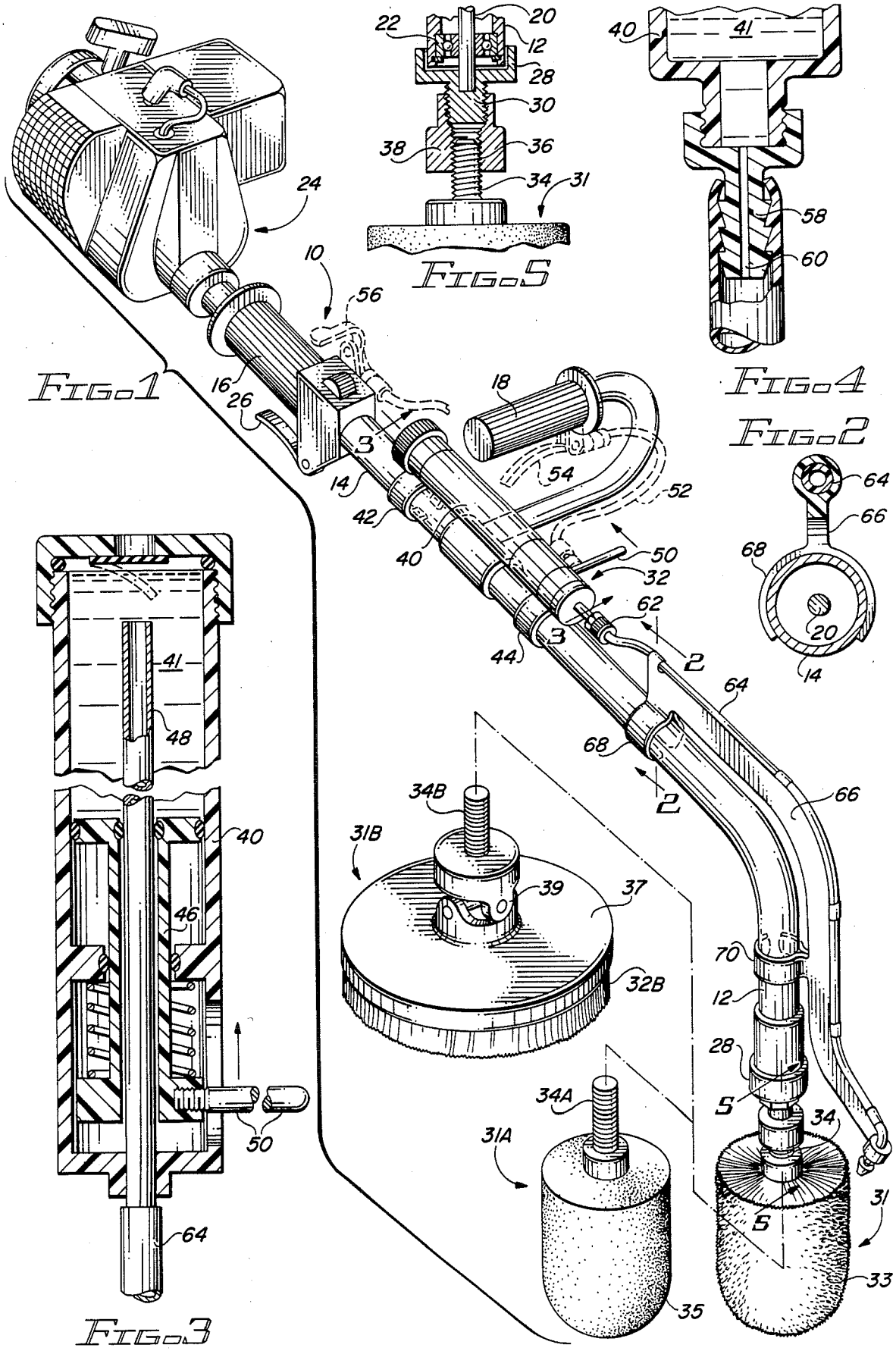
FIG. 1 is a perspective view showing the pool tile cleaning apparatus of the present invention.
FIG. 2 is an eniarged sectional view taken through iine 2—2 of FIG. 1.
FIG. 3 is an enlarged sectional view taken through line 3—3 of FIG. 1, showing one embodiment of the dispenser bottle used with the apparatus.
FIG. 4 is an enlarged fragmentary view showing the outlet portion of an alternative-type of dispenser bottle.
FIG. 5 is an enlarged sectional view taken through line 5—5 of FIG. 1.

Referring more particularly to the drawings, FIG. 1 is a perspective view showing a conventional gasoline powered string trimmer indicated in its entirety by the numeral 10, which has been converted by means of the assembly of the present invention to an apparatus for cleaning pool tile and the like.

The apparatus may utilize any commercially available type of string trimmer 10 such as the type marketed under the trade name "Weed Eater", which is available from Beaird-Poulan/Weed Eater, Division Emerson Eiectric Co. Shreveport, La. 71139-9329 or the type marketed as the "Eager Beaver", by McCulloch Corporation, Los Angeles Calif. Selection of the particular model of string trimmer to be used will be based on a number of factors such as cost, availability, weight and size, and will not significantly effect the operating principles of the invention. However, it should be noted that gasoline powered models are generally preferable to electric models since electric motors, unless properly insuiated, are hazardous when used near water.

As is weli known, a conventional gasoline-powered string trimmer 10 comprises an elongated pole handle having a substantially vertical iower portion 12 and a slanted upper portion 14 which extends rearwardly toward the operator at an angle of approximateiy 45°. An upper hand grip 16 is formed at the operator's end of the pole handle for enabling the operator to grasp the apparatus, and a lower hand grip 18 is provided further down the pole to allow the operator to hold the apparatus with both hands. A drive shaft 20 extends longitudinally through the handle pole and is mounted for rotation therein by means of a suitable bearing member 22. A gasoline engine 24 is mounted at the uppermost end of the handle pole behind the first hand grip 16 for powering the drive shaft 20, and a throttle iever 26 is provided on the upper hand grip 16 for controlling the fiow of fuel to the engine 24. At the opposite end of the handle pole, a collar member 28 is welded or otherwise permanently mounted to the drive shaft 20 for rotation therewith. In most commercially available models of string trimmers, the collar member includes an externally threaded male connector element 30, as shown in FIG. 5, for connection to a mating female element provided on the cutting line head (not shown) or other detechable lawn care accessory. However, in certain other models, the connector element on the collar member 28 is female, while the mating element on the cutting head is male. In either case, the conversion assembly of the present invention requires that the cutting line head or other lawn care accessory, as well as the protective line shield (not shown) be removed from the collar 28 prior to conversion.

The conversion assembly comprises two major components, including a detachable abrasion member 31 for connection to the collar member 28 at the end of the trimmer drive shaft 20, and a detachable dispensing unit 32 for delivering a stream of cleaning solution to the surface of the abrasion member 31.

In a first embodiment of the invention, the abrasion member 31 comprises a substantiaily cylindrical brush having a plurality of bristles 33 which extend radially outwardly with respect to the longitudinal axis of the pole handle of the trimmer. The abrasion member 31 also inciudes a mounting portion for coupling it to the collar 28 at the end of the trimmer's drive shaft 20. in FIG. 5, the mounting portion is shown as an externally threaded, axially extending shank 34 which is received in an internally threaded bore 36 in a specially formed adapter element 38. The opposite end of the bore 36 is dimensioned to receive the externally threaded connector element 30 on collar 28 in order to secure the abrasion member 31 thereto. However, in other models of string trimmers where connector element 30 is formed as a female part, the adapter element 38 would be configured differently, or could be eliminated altogether if shank 34 on the abrasion member 31 were dimensioned to fit directly into the female part. Other well known coupling arrangements could also be utilized.

In a second embodiment of the invention, the abrasion member 31A comprises a pumice stone 35 having a substantially cylindrical outer surface. Like the abrasion member 31 of the first embodiment, the pumice stone 35 includes a mounting element such as an axially extending shank 34A for coupling it to adapter element 38, as shown in FIG. 5. This embodiment is effective for removing thick, soiid deposits of calcium and the like which do not respond to treatment with a bristle-type brush.

While the first two embodlments enable an operator to clean vertical surfaces such as the side walls of a swimming pool while standing on the upper rim of the pool, a third embodiment is recommended for use on miscellaneous other surfaces such as the horizontal portion of the pool steps, cement floors, automobiles and the like. In this embodiment, the abrasion member 31B comprises a brush having a transverse body portion 37 which extends substantially normally to the longitudinal axis of the trimmer handle. A plurality of bristles 32B extend perpendicularly from the body portion in a substantially vertical direction. Preferably, the mounting element 34B of the abrasion member 31B is joined to the body portion 37 by means of a swivel joint 39 which allows the position of the brush relative to the trimmer handle to be adjusted in order to clean slanted surfaces or to allow the brush to yield in response to obstructions or obstacles in its path.

The dispensing unit 32 of the assembly comprises a bottle 40 containing an appropriate cleaning fluid 41 such as an inhibited acid concentrated tile cleaner containing biodegradable surfactants of the type marketed under the trade name "Bio-dex 300" by Bio-dex Laboratories, Scottsdale, Ariz. 85252. The bottle 40 is mounted on the exterior surface of the upper portion 14 of the trimmer's pole handle by means of C-shaped spring clips 42, 44 or other demountable connector members.

In one embodiment of the invention, shown in FIG. 3, the bottle 40 is provided with a discharge assistant such as reciprocable piston 46 which, when actuated, exerts a pressure on the cleaning fluid 41, forcing it out discharge tube 48. An elongated extension rod 50 may be secured to the stem of the piston 46 in order to facilitate actuation of the piston, and if desired, this rod 50 may be connected by means of a control line 52 to a first optional trigger member 54 located in the vicinity of lower hand grip 18 of the pole handle, or to a second optional trigger member 56 located near throttle lever 26 on the upper hand grip 16. Either trigger member would facilitate actuation of the dispenser unit 32 as it would enable the operator to control piston 46 without removing either hand from the hand grips. However, it is felt that the location of first optional trigger member 54 is preferable to that of second optional trigger member 56, since most people tend to keep their stronger, more dominant hand on the lower hand grip 18.

In another embodiment, shown in FIG. 4, the bottle 40 of the dispensing unit 32 is provided with an outlet tube 58 having a small diameter bore 60 for continuously dispensing the cleaning fluid 41 in drip-feed fashion. Since this embodiment lacks means for completely shutting off the flow of fluid 41 from the bottle 40, causing possible waste of fluid, it may be less desirable than the pump-type dispenser of the other embodiment. However, it may be more economical to produce in the long run because of its simplicity and smaller number of parts required.

In either case, the bottle 40 is connected, preferably by means of a quick disconnect coupling 62 as shown in FIG. 1, to an elongated, flexible discharge hose 64 for directing the cleaning fluid 41 to the surface of the abrasion member 31 or the tile or other surface being cleaned. The discharge hose 64 is supported in spaced relation to the exterior surface of the lower portion 12 of the pole handle by means of a rigid guide member 66 which, like the dispenser bottle 40, is provided with U-shaped spring clips 68, 70 or connector members for demountably securing it to the pole handle.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. An apparatus for cleaning swimming pool tile, said apparatus comprising:

(a) an elongated pole handle, said pole handle including a substantially vertical lower portion for reaching downwardly into a swimming pool, and a slanted upper portion for extending rearwardly from said lower portion towards an operator standing near the edge of a swimming pool;

(b) a drive shaft mounted for rotation within said pole handle;

(c) a fuel-consuming motor for rotating said drive shaft;

(d) an abrasion member detachably mounted on the lower end of said drive shaft for rotation therewith; and (e) a dispensing unit detachably mounted on the exterior surface of said pole handle for delivering cleaning fluid to said abrasion member.

2. The apparatus of claim 1, in which said motor is gasoline powered.

3. The apparatus of claim 1, in which said slanted upper portion of said pole handle extends at an angle of approximately 45° degrees with respect to said substantially vertical lower portion.

4. The apparatus of claim 1, in which said abrasion member comprises a substantially cylindrical brush for cleaning the vertical side walls of a swimming pool, said brush having a plurality of bristles which extend radially outwardly with respect to the longitudinal axis of said pole handle.

5. The apparatus of claim 1, in which said abrasion member comprises a pumice stone having a substantially cylindrical outer surface, for scrubbing thick and hard calcium deposits off the vertical side walls of a swimming pool.

6. The apparatus of claim 1, in which said abrasion member comprises a brush for cleaning horizontal surfaces, said brush including a transverse body portion which extends substantially normally to the longitudinal axis of said pole handle, and a plurality of bristles which extend perpendicularly from said body portion in a substantially vertical direction.

7. The apparatus of claim 1, in which said dispensing unit comprises:

(a) a bottle containing cleaning fluid;

(b) means for detachably mounting said bottle on said pole handle; and (c) a discharge hose leading from said bottle for directing said cleaning fluid onto said abrasion member.

8. The apparatus of claim 7, further comprising guide means detachably mounted on the lower portion of said pole handle for supporting said discharge hose in spaced relation to the exterior surface of said pole handle.

9. The apparatus of claim 7, in which said dispensing unit comprises a piston-pump for assisting the discharge of cleaning fluid from said bottle.

10. The apparatus of claim 7, in which said bottle includes an outlet tube having a small diameter bore for continuously dispensing the cleaning fluid in a drip-feed fashion.

11. An apparatus for cleaning tile surfaces, said apparatus comprising:

(a) a string trimmer body, said string trimmer body including;

(i) an elongated pole handle, said pole handle having a substantially vertical lower portion and a slanted upper portion.

(ii) an upper hand grip formed at the top of said slanted upper portion of said pole handle, (iii) a lower hand grip formed below said upper hand grip, (iv) a drive shaft mounted for rotation within said pole handle, (v) a gasoline-powered motor mounted at the top of said pole handle for rotating said drive shaft, (vi) a collar member mounted at the bottom of said drive shaft and rotatable with said drive shaft, (vii) a connector element provided on said collar member for connection to a detachable lawn care accessory;

(b) an abrasion member detachably mounted on said collar member in place of said lawn care accessory; and (c) a dispensing unit detachably mounted on the exterior surface of said pole handle for delivering cleaning fluid to said abrasion member, said dispensing unit including;

(i) a bottle containing cleaning fluid, (ii) a discharge hose leading from said bottle for directing said cleaning fluid onto said abrasion member.

12. The apparatus of claim 11, in which said abrasion member comprises:

(a) a substantially cylindrical brush for cleaning vertical tile surfaces, said brush having a plurality of bristles extending radially outwardly with respect to the longitudinal axis of said pole handle; and (b) a mounting portion for connecting said brush to said collar on said string trimmer drive shaft.

13. The apparatus of claim 11, in which said abrasion member comprises:

(a) a pumice stone having a substantially cylindrical outer surface for removing hard calcium deposits from vertical tile surfaces; and (b) a mounting portion for connecting said brush to said collar on said string trimmer drive shaft.

14. The apparatus of claim 11, in which said abrasion member comprises:

(a) a brush for cleaning horizontal tile surfaces, said brush including a transverse body portion which extends substantially normally to the longitudinal axis of said pole handle, and a plurality of bristles which extend perpendicularly from said body portion in a substantially vertical direction; and (b) a mounting portion for connecting said brush to said collar on said string trimmer drive shaft.

15. The apparatus of claim 14, further comprising a swivel joint between said body portion and said mounting element, for allowing the angle of said brush relative to said handle pole to be adjusted.

16. The apparatus of claim 12 further comprising an adapter element intermediate said abrasion member and said collar for coupling said abrasion member to said collar, said adapter element comprising means on one end for engaging said mounting portion of said abrasion member, and means at the opposite end for engaging said connector element on said collar.

17. The apparatus of claim 13 further comprising an adapter element intermediate said abrasion member and said collar for coupling said abrasion member to said collar, said adapter element comprising means on one end for engaging said mounting portion of said abrasion member, and means at the opposite end for engaging said connector element on said collar.

18. The apparatus of claim 14 further comprising an adapter element intermediate said abrasion member and said collar for coupling said abrasion member to said collar, said adapter element comprising means on one end for engaging said mounting portion of said abrasion member, and means at the opposite end for engaging said connector element on said collar.

19. The apparatus of claim 11, in which said dispensing unit comprises a piston-pump for assisting the discharge of cleaning fluid from said bottle.

20. The apparatus of claim 19, further comprising trigger means proximate one of said hand grips for remotely actuating said piston pump to discharge said fluid from said bottle.

21. A conversion assembly for use in combination with the body of a string trimmer of the type including an elongated pole handle having a substantially vertical lower portion and a slanted upper portion, a drive shaft mounted for rotation with said pole handle, a motor for rotating said drive shaft, a collar member mounted at the bottom of said drive shaft and rotatable with said drive shaft, and a connector element provided on said collar member for connection to a detachable lawn care accessory, said conversion assembly comprising:

(a) an abrasion member for detachably mounting on said collar member in place of said lawn care accessory in order to connect said abrasion member to an apparatus for scrubbing various surfaces including pool tile; and (b) a dispensing unit detachably mounted on the exterior surface of said pole handle for delivering cleaning fluid to said abrasion member.

22. The conversion assembly of claim 21, in which said abrasion member comprises a substantially cylindrical brush for cleaning vertical surfaces, said brush having a plurality of bristles extending radially outwardly with respect to the longitudinal axis of said pole handle when said brush is mounted on said collar.

23. The conversion assembly of claim 21, in which said abrasion member comprises a pumice stone having a substantially cylindrical outer surface.

24. The conversion assembly of claim 19 in which said abrasion member comprises a brush for cleaning horizontal surfaces, said brush including a transverse body portion which extends substantially normally to the longitudinal axis of said pole handle when said brush is mounted on said collar, and a plurality of bristles which extend perpendicularly from said body portion in a substantially vertical direction.

* * * * *